US006045294A

United States Patent [19]

Hansen

[11] Patent Number: 6,045,294

[45] Date of Patent: Apr. 4, 2000

[54] REFLECTIVE LANE MARKER

[75] Inventor: Henry R. Hansen, Sherwood Park, Canada

[73] Assignee: Reflect-A Lane Company, Ltd., Sherwood Park, Canada

[21] Appl. No.: 09/141,161

[22] Filed: Aug. 27, 1998

[51] Int. Cl.[7] ..... E01F 9/06

[52] U.S. Cl. ..... 404/14; 404/16

[58] Field of Search ..... 404/9, 12, 14, 404/15, 16; 116/63 R, 63 P, 209

[56] References Cited

U.S. PATENT DOCUMENTS

| | | | |
|---|---|---|---|
| 2,192,878 | 3/1940 | Beebe | 404/10 |
| 3,936,208 | 2/1976 | Baynes et al. | 404/16 |
| 4,753,548 | 6/1988 | Forrer | 404/15 |
| 4,854,768 | 8/1989 | Flanagan et al. | 404/11 |

*Primary Examiner*—James A. Lisehora

[57] ABSTRACT

The invention provides a lane marker comprising an elongate housing having a top portion length shorter than the base portion length, the ends of the housing tapering from the end of the base portion up to the end of the top portion such that a part of the ends of the base portion are open to the top. A vertical reflector is secured inside the reflector end of the housing, between the top portion and the base portion and a horizontal reflector is secured on the base portion of the reflector end of the housing. The tapered design reduces damage to the marker and to tires, and exposes mounting holes in the base portion which are easily accessible from the top.

10 Claims, 2 Drawing Sheets

REFLECTIVE LANE MARKER

This invention deals with the field of loading docks and bays and in particular with a reflective lane marker for use in such areas.

BACKGROUND

Large trucks must often back up into loading docks and bays where there is little manoeuvring room and/or poor visibility. Often the truck must turn as well while backing up to the site. Presently, reflective paint is often used to mark lanes to guide trucks however the marks are difficult to see as the reflection angle is too flat. Raised reflectors are known however the reflection angle on these is often too flat as well, with little reflectance in the horizontal plane. These raised reflectors are subject to damage from trucks, snow plow and so forth.

Sometimes lanes are marked temporarily with pylons. Pylons are subject to damage and bulky to carry by truck drivers who wish to have marker available to them as they travel.

SUMMARY OF THE INVENTION

It is an object of the present invention to provide a lane marker that is highly visible from a truck entering the lane.

It is a further object of the present invention to provide such a lane marker that may be permanently mounted and will resist damage from traffic.

It is a further object of the present invention to provide such a lane marker that may be carried easily and set out to temporarily mark a lane.

The invention accomplishes these objects providing a lane marker comprising an elongate housing having a top portion length shorter than the base portion length, the ends of said housing tapering from the end of said base portion up to the end of said top portion such that a part of the ends of said base portion are open to the top; a vertical reflector secured inside the reflector end of said housing, between said top portion and said base portion; and a horizontal reflector secured on the base portion of said reflector end of said housing.

The combination of vertical and horizontal reflectors greatly enhances the visibility of the marker from a truck entering the lane, as the reflectors gather and reflect light from each other. The vertical reflector is well protected from traffic damage as it is tucked inside the end of the housing. If desired to mark the lane from both directions, a second vertical reflector and a second horizontal reflector could be secured in the other end of said housing.

For permanent mounting, a vertical mounting hole could be provided in the end of the base portion open at the top and in said horizontal reflector. The vertical and horizontal reflectors could be formed from one piece of reflective material bent at a substantially right angle. This piece of reflective material could be conveniently secured in the housing by a mounting bolt through the mounting hole into a driving surface beneath the reflector.

The shape of the housing is designed to resist damage from traffic. The elongate housing could a rectangular steel tube. Traffic will generally flow up and down the lane, and so wheels will generally follow the taper up and over the housing, causing no damage to tires. If desired the housing could be shaped such that the base portion is wider than the top portion and wherein the sides of the housing taper from the base to the top. With the base flush with the driving surface such a design would allow snow-plows are the like to pass over the marker without damage.

The marker and the driving surface could be further protected from damage by making the mounting bolt brittle such that it will break when subjected to a substantial force.

For portable temporary use, the bottom side of the base could be covered with a resilient material to reduce sliding when placed on a driving surface.

For maximum visibility the housing could coloured to be highly visible in the particular location.

DESCRIPTION OF THE DRAWINGS

While the invention is claimed in the concluding portions hereof, preferred embodiments are provided in the accompanying detailed description which may be best understood in conjunction with the accompanying diagrams where like part in each of the several diagrams are labeled with like numbers, and where:

DETAILED DESCRIPTION OF THE ILLUSTRATED EMBODIMENTS

FIGS. 1, 2, 3 and 4 show a preferred embodiment of the invention.

Figure 1:
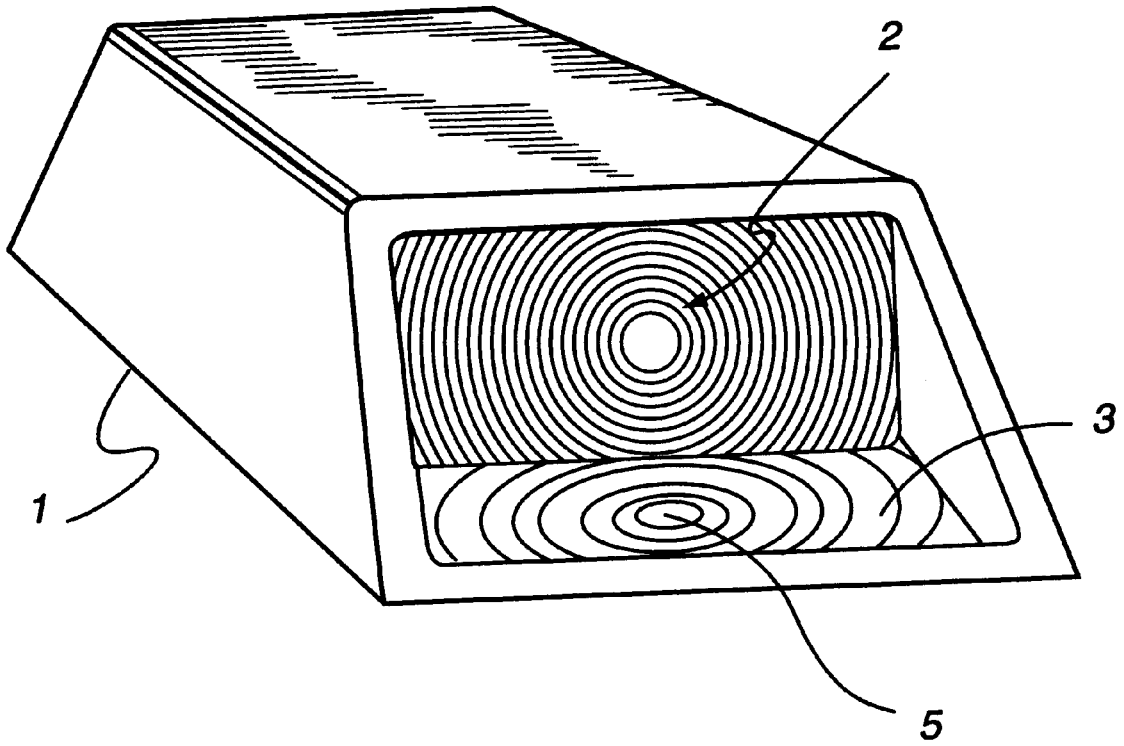
FIG. 1 is a perspective view of the preferred embodiment.
Figure 2:
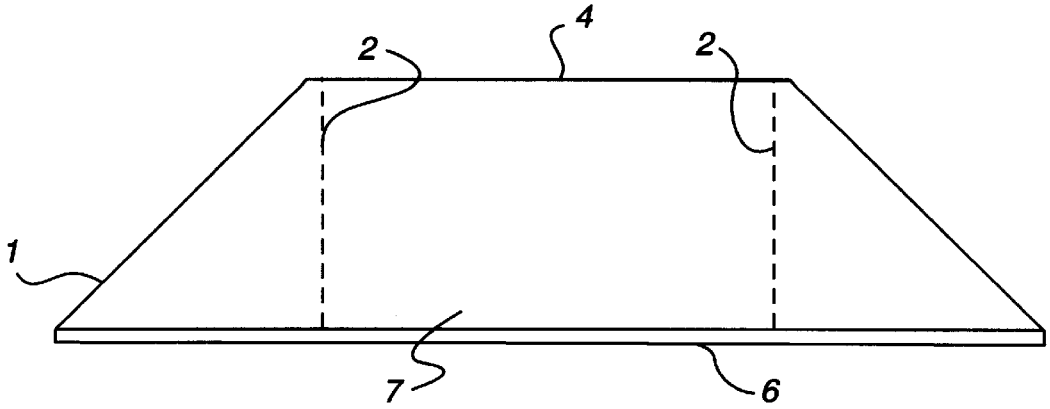
FIG. 2 is a side view of the embodiment of FIG. 1.
Figure 3:
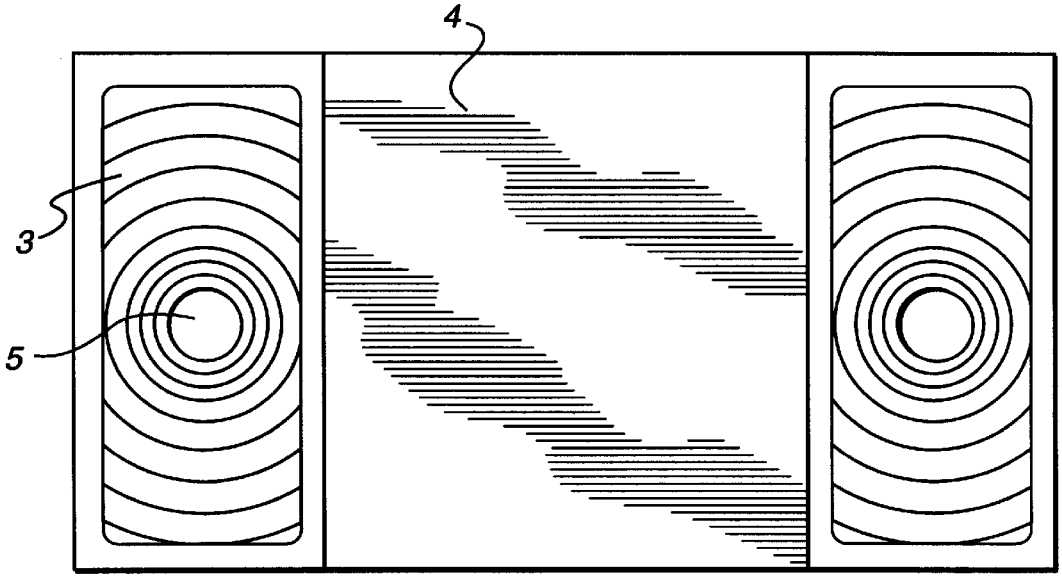
FIG. 3 is a top view of the embodiment of FIG. 1.
Figure 4:
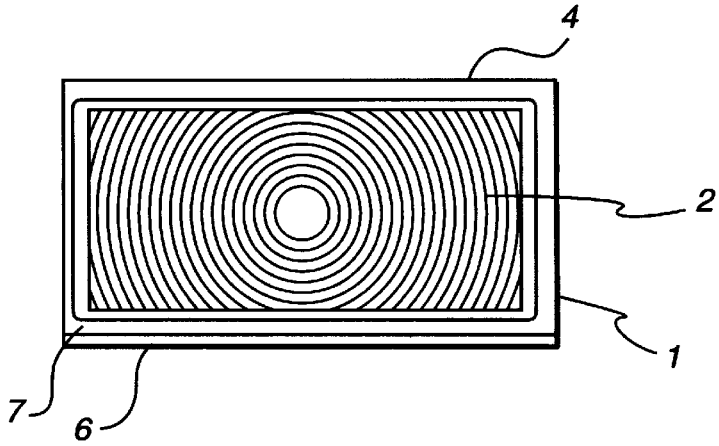
FIG. 4 is an end view of the embodiment of FIG. 1.

Housing 1 is a rectangular steel tube, cut at a 45 degree angle at each end as shown in FIG. 2. Vertical reflector 2 and horizontal reflector 3 are formed from one piece of reflective material with a right angle bend. The vertical reflector 2 is tucked into the end of the housing 1 under the top portion of the housing 4, where it is protected from damage. The reflectors 2 and 3 are secured in place by a mounting bolt through mounting hole 5 which also secures the marker to the driving surface. The mounting holes 5 are easily accessible from the top for installation of mounting bolts. In this embodiment there are reflectors mounted in each end of the housing 1, so that the lane is marked for incoming and outgoing traffic.

FIG. 2 also shows the addition of a resilient pad 6 attached to the base 7 of the housing. The pad 6 will reduce sliding of the marker on the driving surface when it is used as a portable marker. Where the marker is portable the vertical and horizontal reflectors 2 and 3 will be fastened in place by adhesive, welding or any suitable means.

For maximum visibility the housing 1 is painted with a suitable colour contrasting with its location, such as white or orange. Reflective paint could be used.

Thus it can be seen that the invention accomplishes all of its stated objectives. The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

I claim:

1. A lane marker comprising:

an elongate housing having a top portion length shorter than a base portion length, wherein ends of said housing are tapering from an end of said base portion up to an end of said top portion such that a part of the ends of said base portion are upwardly open;

a vertical reflector secured inside a first reflector end of said housing, between said top portion and said base portion; and a horizontal reflector secured on the base portion of said first reflector end of said housing.

2. The invention of claim 1 further comprising a second vertical reflector and a second horizontal reflector secured in a second reflector end of said housing.

3. The invention of claim 1 further comprising a vertical mounting hole in said base portion of said first reflector end and in said horizontal reflector.

4. The invention of claim 3 wherein said vertical and horizontal reflectors are formed from one piece of reflective material bent at a substantially right angle.

5. The invention of claim 4 wherein said one piece of reflective material is secured in said housing by a mounting bolt through said mounting hole.

6. The invention of claim 5 wherein said mounting bolt is brittle such that it will break when subjected to a substantial force.

7. The invention of claim 1 wherein said base portion is wider than said top portion and wherein sides of said housing taper from said base to said top portion.

8. The invention of claim 1 wherein said elongate housing is a rectangular steel tube.

9. The invention of claim 1 wherein a bottom side of said base portion is covered with a resilient material to reduce sliding when placed on a driving surface.

10. The invention of claim 1 wherein said housing is colored to be highly visible in a particular location.

* * * * *